United States Patent [19]

Bryson

[11] 4,303,617

[45] Dec. 1, 1981

[54] ATMOSPHERIC CONTROL APPARATUS

[75] Inventor: John D. Bryson, Milwaukee, Wis.

[73] Assignee: Vaportek, Inc., Milwaukee, Wis.

[21] Appl. No.: 174,862

[22] Filed: Aug. 4, 1980

Related U.S. Application Data

[63] Continuation of Ser. No. 31,661, Apr. 19, 1979, abandoned.

[51] Int. Cl.[3] ..... C01F 1/00; C01G 15/00

[52] U.S. Cl. ..... 422/123; 422/5; 422/124; 422/306; 55/279

[58] Field of Search ..... 422/5, 120, 122, 123, 422/124, 306; 126/113; 55/279

[56] References Cited

U.S. PATENT DOCUMENTS

| | | | |
|---|---|---|---|
| 2,523,373 | 9/1950 | Jennings et al. | 422/124 |
| 3,100,679 | 8/1963 | Kritzer | 55/279 |
| 3,497,312 | 2/1970 | Zeff et al. | 422/122 |
| 3,505,989 | 4/1970 | Truhan | 55/279 |
| 3,576,593 | 4/1971 | Cicirello | 422/121 |
| 4,117,883 | 10/1978 | Feldmann | 165/DIG. 2 |

*Primary Examiner*—William F. Smith
*Assistant Examiner*—Chris Konkol
*Attorney, Agent, or Firm*—Michael, Best & Friedrich

[57] ABSTRACT

An atmospheric control apparatus for use in a forced air ventilation duct is described having an inlet means to receive air from the inside of said duct attached to a replaceable deodorant cartridge, which is itself attached to outlet means terminating within the duct downstream of the inlet to supply an atmospheric control substance such as an odorant or deodorant into the air stream. Air flow through the cartridge is accomplished by the differential pressures present at the inlet and outlet means in the air duct.

6 Claims, 3 Drawing Figures

ATMOSPHERIC CONTROL APPARATUS

This is a continuation of application Ser. No. 31,661, filed Apr. 19, 1979 now abandoned.

BACKGROUND OF THE INVENTION

Forced air ventilation systems are commonly utilized in houses, offices and industrial buildings to provide a controlled atmosphere at particular locations throughout those units. Different locations within those units have different atmospheric requirements and it often has been a problem to provide selective atmospheres based on the requirements of the particular location.

For example, in the home it may be desirable to provide a source of odorant or deodorant in a bathroom area or the like without substantially affecting the atmosphere in other rooms in the home. Sometimes, residents having certain physical impairments must be provided with controlled atmospheres-for example, atmospheres having high humidity or the presence of a vapor to assist breathing. In industrial units, it is not unusual to have local production of malodors which are more easily controlled at the source before they spread to other areas in the buildings.

Forced air ventilation systems provide certain advantages for atmospheric control systems, such as rapid and complete dispersion of vapors introduced into the atmosphere. However, heretofore, those systems also have been difficult to work with since they are usually operated from a single power source from an air source remote from many of the locations at which ventilation is occuring. The locations most often are supplied from a central air source by appropriate duct-work. Most homes, for example, have the air inlet and powered blower located in the basement or other areas remote from the living quarters. Many industrial buildings have units located on the roofs of the buildings. Simply placing a source of odorant or the like in the air inlet results in exposure to the control substance of the entire unit fed by the ventilation system. Clearly, that exposure is not desirable when only atmospheric control at a specific location is required.

Additionally, specific locations remote from the central power source often do not have convenient power sources for driving independent atmospheric control units. Also, it is often desirable that noise levels be kept to a minimum and for that reason independent, power driven units are not entirely satisfactory.

The need for a simple, economical atmospheric control system for use in units having forced air ventilation systems is readily apparent.

SUMMARY OF THE INVENTION

An atmospheric control apparatus is provided which can be utilized locally in forced air ventilation systems without an independent power source. The control apparatus is adapted to be attached directly to a piece of ductwork of the ventilation system and utilizes the differential pressure present at different positions within the interior of the duct to supply an atmospheric control substance into the air stream.

Typically, an upstream air inlet is provided extending through the wall of the duct with the interior end of the inlet member having an opening facing into the direction of air flow in the duct. The inlet member is connected externally of the duct to a source of atmospheric control substance, such as an odorant, deodorant, insecticide, inhalation vapor, or the like. The control substance source is conveniently present in a replaceable cartridge unit which can be removed when depleted and replaced with a fresh cartridge. An outlet is provided from the control substance source extending into the interior of the duct at a position downstream from the inlet. Openings in the portion of the outlet located within the interior of the duct are positioned to face away from the direction of air flow. The differential pressure across the inlet and outlet within the air duct is sufficient to drive the control unit so that continuous air flow through the unit dispensing the control substance is achieved.

Figure 1:
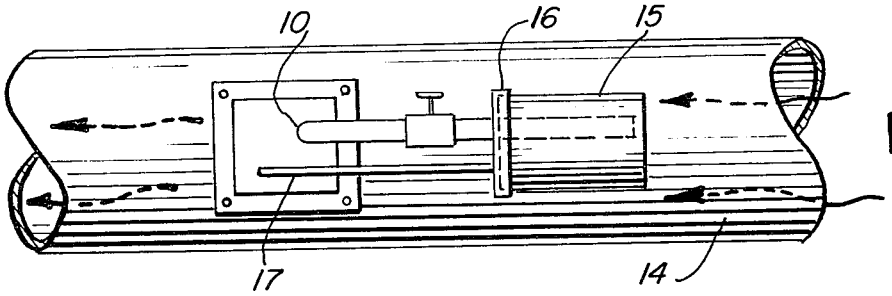
FIG. 1 is a side view of the apparatus as mounted on the side of a typical rectangular ventilation duct.
Figure 2:
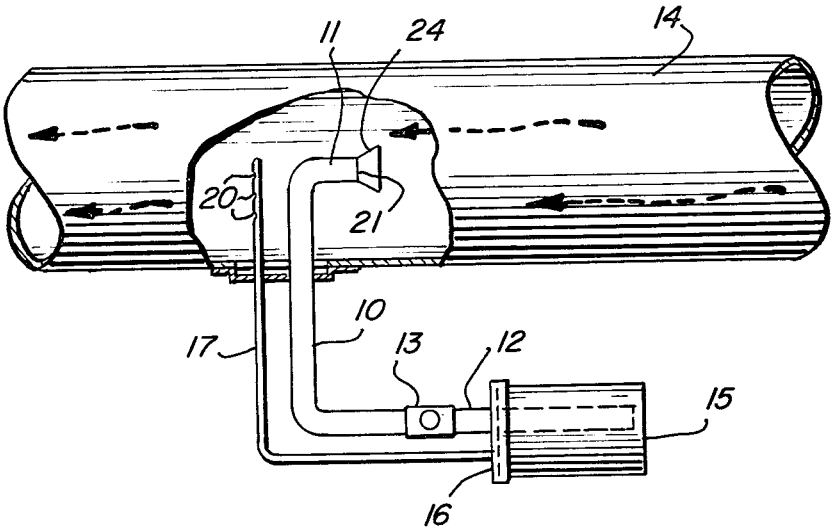
FIG. 2 is a top view of the apparatus of FIG. 1.
Figure 3:
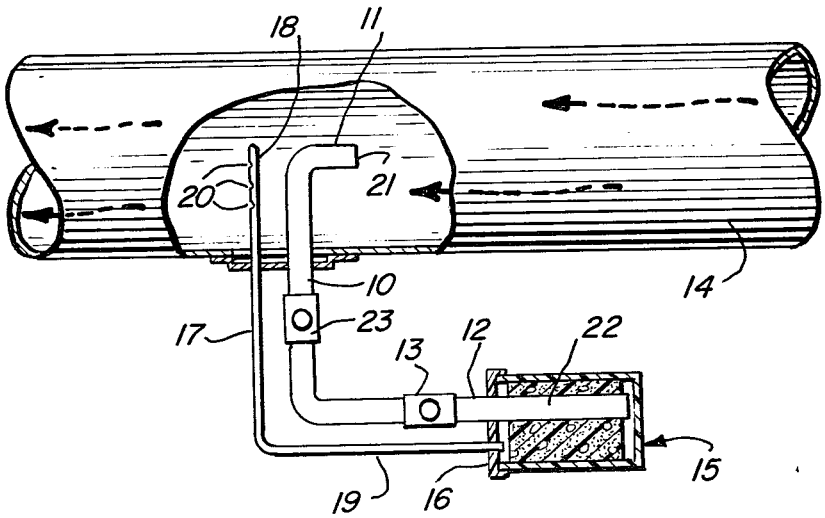
FIG. 3 is a top view of an alternate embodiment of the invention.

Before explaining at least one embodiment of the invention in detail, it is to be understood that the invention is not limited in its application to the details of construction and the arrangements of the components set forth in the following description or illustrated in the drawings. The invention is capable of other embodiments and of being practiced and carried out in various ways. Also, it is to be understood that the phraseology and terminology employed herein is for the purposes of description and should not be regarded as limiting.

DESCRIPTION OF THE PREFERRED EMBODIMENTS

As illustrated in the drawings, the atmospheric control apparatus comprises dispensing means such as a cannister or cartridge 15 communicating with the interior of the ventilation duct 14 through inlet means 10 and outlet means 17. The cartridge 15 is located externally of duct 14. Inlet means such as tubular conduit 10 having a first end 11 which is positioned within the interior of duct 14 and a second end 12 which communicates with the interior of cartridge 15 is provided. End 12 preferably extends to a point near the bottom of cartridge 15 which is filled with a source 22 of control substance through or over which air can pass to outlet means 17.

Outlet means such as tubular conduit 17, has a first end 18 located within the interior of duct 14 at a position downstream from inlet 10. End 18 preferably is provided with a series of orifices 20 on the downstream side of the conduit 17. Second end 19 of conduit 17 is in fluid communication with cartridge 15 and receives treated air which has been passed over the control substance element 22. The differential pressure existing between opening 21 and orifices 20 creates a flow of air through the system without any independent power source being required.

Valve means 13 is placed in conduit 10 externally of duct 14 to control the rate of air flow through cartridge 15 and thus control the rate at which control substance from element 22 is dispensed into the atmosphere.

The end 11 of conduit 10 preferably is bent to align a short segment of the conduit parallel to the airflow and direct opening 21 into the flow stream. Improved air movement through the apparatus is achieved using that configuration.

Ends 12 and 19 of conduits 10 and 17, respectively, are attached conveniently to a lid 16 having means for engaging the cannister 15. Cooperative threads on lid 16 and cannister 15 or a snap-fit closure can be utilized so that cannister 15 can easily be removed and replaced when replenishing the unit with a fresh element 22.

Conduit 10 generally is of larger diameter than conduit 17 to facilitate air flow through the apparatus. A one inch diameter inlet conduit 10 and a one-quarter inch outlet conduit 17 have been found to be satisfactory for most applications. In some instances, it is desirable to put a collecting element 24 on the end 11 of conduit 10 to assure an adequate flow of air through the apparatus.

The apparatus is most advantageous since it can be attached to duct work very near the location in which the atmosphere is to be controlled. More than one unit can be utilized at the same time at different locations and for different effects. For example, one can locate an apparatus containing deodorant in a duct feeding into a bathroom and another apparatus containing an inhalation vapor into a room wherein the occupant has some respiratory problem responsive to the vapor.

Usually the apparatus would be attached to the pressure side of the ventilation system. However, if it is desirable to control the total atmosphere of the unit fed by the ventilation system, the control apparatus can be optionally placed on the suction side. Under those conditions, the embodiment utilizes an auxiliary opening 23 in inlet conduit 10. When placed on the suction side, opening 21 is closed by a cap or the like and air is drawn in through opening 23 externally of the duct by the fan system powering the ventilation system. Opening 23 can be provided by a conventional tubular tee placed in conduit 10 which is closed by a cap (not shown) when the unit is used on the pressure side.

Cannister 15 and element 22 are selected from the many conventional units which are available to provide a convenient source of odorant, deodorant, medicament, odor neutralizing vapor, or other control substance depending on the particular application intended. The control apparatus has been shown in the drawings as used with rectangular ductwork. Modification of the unit to allow attachment to tubular ductwork will be obvious to those skilled in the art. Conduits 10 and 17 are sealed at the juncture with duct 14 by conventional means to prevent loss of air around their periphery.

What is claimed is:

1. An atmospheric control apparatus for use in a forced air ventilation duct, said control apparatus comprising air inlet means having a first end in fluid communication with the interior of said duct, a second end positioned externally of said duct, and an auxiliary opening positioned externally of said duct, means for optionally closing said auxiliarly opening, means for optionally closing said first end from fluid communication with the interior of said duct, outlet means positioned downstream from said air inlet means and having a first end in fluid communication with the interior of said duct and a second end positioned externally of said duct, and dispensing means interposed between said second end of said inlet means and said second end of said outlet means for receiving air from said inlet means and dispensing neutralizing vapor or odorant into said outlet means, whereby said atmospheric control apparatus is selectively operable with said first end of said air inlet means being in fluid communication with the interior of said duct and said auxiliary opening being closed or is operable with said auxiliary opening being in communication with the environment external to said duct and said first end of said air inlet means being closed.

2. An apparatus as in claim 1 wherein said first end of said inlet means has an opening facing into the direction of air flow in the duct.

3. An apparatus as in claim 2 wherein said first end of said outlet means has an opening facing away from the direction of air flow in the duct.

4. An apparatus as in claim 2 wherein said inlet means is a tubular conduit.

5. An apparatus as in claim 4 wherein said outlet means is a tubular conduit having a plurality of orifices along a portion of its length for positioning within the interior of said duct, said orifices facing away from the direction of flow.

6. An apparatus as in claim 1 wherein said dispensing means comprises a deodorant cartridge.

* * * * *